US005121995A

United States Patent [19]

Newman et al.

[11] Patent Number: 5,121,995

[45] Date of Patent: Jun. 16, 1992

[54] LOOP-HANDLE BAG WITH IMPROVED ACCESSIBILITY FEATURE

[75] Inventors: William R. Newman, Neenah; Robert C. Austerman, Appleton; Karl K. Oliver, Neenah, all of Wis.

[73] Assignee: Kimberly-Clark Corporation, Neenah, Wis.

[21] Appl. No.: 573,439

[22] Filed: Aug. 27, 1990

[51] Int. Cl.[5] ..... B65D 33/10

[52] U.S. Cl. ..... 383/29; 383/8; 383/21; 383/207

[58] Field of Search ..... 383/8, 10, 88, 29, 25, 383/21, 207, 200; 206/604, 633

[56] References Cited

U.S. PATENT DOCUMENTS

| | | | |
|---|---|---|---|
| B1 4,573,203 | 4/1989 | Peppiatt | 383/29 |
| 2,651,409 | 9/1953 | Fay | 206/57 |
| 2,998,911 | 9/1961 | Hahn et al. | 229/66 |
| 3,012,692 | 12/1961 | Petersen | 221/63 |
| 3,124,298 | 3/1964 | Repko | 229/66 |
| 3,161,336 | 12/1964 | Loescher | 225/106 |
| 3,162,353 | 12/1964 | Sylvester et al. | 229/53 |
| 3,174,644 | 3/1965 | Kaltman et al. | 221/63 |
| 3,826,361 | 7/1974 | Heckrodt | 206/409 |
| 4,062,486 | 12/1977 | Goodrich | 206/626 |
| 4,175,673 | 11/1979 | McDonald et al. | 221/63 |
| 4,252,269 | 2/1981 | Peppiatt | 229/54 R |
| 4,328,655 | 5/1982 | Spencer et al. | 53/439 |
| 4,487,318 | 12/1984 | Roen | 206/554 |
| 4,539,705 | 9/1985 | Baines | 383/8 |
| 4,540,091 | 9/1985 | Habock | 206/494 |
| 4,550,439 | 10/1985 | Peppiatt et al. | 383/8 |
| 4,557,385 | 12/1985 | Robinson | 206/620 |
| 4,633,649 | 1/1987 | Gautier et al. | 53/413 |
| 4,685,276 | 8/1987 | Kiel | 53/459 |
| 4,691,368 | 9/1987 | Roessiger | 383/10 |
| 4,713,839 | 12/1987 | Peppiatt | 383/29 |
| 4,717,262 | 1/1988 | Roen et al. | 383/120 |
| 4,721,396 | 1/1988 | Sengewald | 383/8 |
| 4,730,942 | 3/1988 | Fulcher | 383/7 |
| 4,730,943 | 3/1988 | Johnson | 383/8 |
| 4,738,546 | 4/1988 | Sengewald | 383/7 |
| 4,838,429 | 6/1989 | Fabisiewicz et al. | 206/605 |
| 4,854,733 | 8/1989 | Schwinn | 383/25 |
| 4,867,575 | 9/1989 | Wood | 383/17 |
| 4,874,255 | 10/1989 | Ball et al. | 383/8 |
| 4,874,256 | 10/1989 | Baines | 383/21 |
| 4,877,335 | 10/1989 | Barnard | 383/6 |
| 4,877,336 | 10/1989 | Peppiatt | 383/8 |
| 4,890,934 | 1/1990 | Feaver et al. | 383/10 |
| 4,934,535 | 6/1990 | Muckenfuhs et al. | 206/610 |
| 4,966,286 | 10/1990 | Muchenfuhs | 383/10 |
| 4,989,993 | 2/1991 | Barnard | 383/10 |
| 5,033,868 | 7/1991 | Pappiatt | 383/10 |

FOREIGN PATENT DOCUMENTS

| | | | |
|---|---|---|---|
| 0349050 | 1/1990 | European Pat. Off. | 383/8 |
| 3629563A1 | 2/1988 | Fed. Rep. of Germany . | |
| 2035258A | 6/1980 | United Kingdom . | |

*Primary Examiner*—Stephen Marcus
*Assistant Examiner*—Christopher McDonald

[57] ABSTRACT

The present invention provides a distinctive bag for receiving and containing selected articles. The bag includes a front panel having two opposed side regions and a top edge region. A back panel having two opposed side edge regions and a tip edge region is connected in facing relation to the front panel along the side edge regions thereof. A top gusset is connected to the top edge regions of the front panel. A handle web also connects to the top edge regions of the front and back panels to provide a carrying loop. The carrying loop is constructed to bridge over the top gusset and between the front and back panels in a configuration arranged to provide for an arm-suspension of the bag with the loop. The carrying loop provides at least two loop faces with each of the loop faces having at least one hand-grip region. Formed in each hand-grip region, there is a hand-grip opening configured to provide for a hand suspension of the bag. The carrying loop has an appointed separation section located between the hand-grip openings. The appointed separation section extends generally aligned with the top edge region of the front panel and is constructed with sufficient tensile load capacity to permit the arm-suspension of the bag while the bag is substantially filled with the articles.

31 Claims, 7 Drawing Sheets

LOOP-HANDLE BAG WITH IMPROVED ACCESSIBILITY FEATURE

FIELD OF THE INVENTION

The present invention relates to flexible plastic bags for receiving and containing packaged articles. More particularly, the present invention relates to a plastic bag having an improved carrying handle system.

BACKGROUND OF THE INVENTION

Bag packages composed of flexible polymer materials have been used for packaging various types of products, such as infant diapers, feminine care products and incontinence garments. The bags allow a packaging of the articles to create a carton-like look and configuration which facilitates transportation and display on retail shelves. The bags typically include handles to facilitate the carrying of individual packages from the retail shelves.

For example, D. Barnard U.S. Pat. No. 4,877,335 issued Oct. 31, 1989, describes a bottom-loaded plastic bag having ear handles on opposite sides of the bag. Each ear handle includes a substantially circular hand-receiving opening and a base portion which extends substantially the full width of the filled bag. The ear handles may be initially connected together by an easily breakable connection. This connection holds the ear handles together until they are pulled apart by a user.

H. Peppiatt U.S. Pat. No. 4,252,269 issued Feb. 24, 1981, describes a bag of polymeric plastic material which has an opening at one end and a gusset at the opposite end. Within the gusset there is disposed a handle welded to front and rear panels of the bag along a fold line. The handle is shorter than the length of the gusset.

U.S. Pat. No. B1 4,573,203 (Reexamination Certificate) issued Apr. 18, 1989 (patent issued Feb. 25, 1986) describes a reusable plastic bag with a loop handle. The bag is for packaging goods in a sealed manner with perforations being provided to facilitate access to the goods without interfering with the reusability of the bag.

H. Peppiatt U.S. Pat. No. 4,713,839 issued Dec. 15, 1987, describes a resealable, reusable, flexible plastic bag with a loop handle for packaging heavy loads. The bag includes front and rear outer panels and front and rear inner panels. A gusset connects the outer panels at a first end of the bag. Another gusset connects the inner panels at the first end of the bag. A handle, defined by a loop of flexible plastic material, is welded at each of its ends to a separate one of the outer panels, outside the outer gusset. The handle is provided with a line of perforations which bisects the handle. Preferably, the handle is narrower at its bight and has a total length which is longer than the width of the outer gusset so that the loop can be slipped over a person's arm.

J. Wood U.S. Pat. No. 4,867,575 issued Sep. 19, 1989 describes a bag which includes a handle web heat sealed to the gusset end of a bag web. The bag is a bottom filled top gusset bag which assumes a carton shape when filled. The handle web has a central portion which extends over the gusset. Substantially D-shaped hand openings are formed in the handle web. These openings have inwardly-directed arcuate sides and substantially flat outwardly-directed sides. Rounded corners are formed where the arcuate sides meet the flat sides.

K. Sendewal U.S. Pat. No. 4,721,396 issued Jan. 26, 1988 describes a bag for fluidic commodities. The bag is formed of a hose of thermoplastic film material and includes a body having side folds and formed by two opposing walls welded to each other at least at their upper ends. The bag has a loop-shaped gripping handle formed by two opposite strips cut out from the blank of the bag and welded to each other at the upper ends.

Conventional plastic bags, such as those described above, have not provided the desired combination of a convenient carrying handle system and a substantially interference free access to the contained articles through the top of the bag.

BRIEF DISCLOSURE OF THE INVENTION

The present invention provides a distinctive bag for receiving and containing selected articles. Generally stated, the bag includes a front panel having two opposed side edge regions and a top edge region. A back panel has two opposed side edge regions and a top edge region, and the back panel is connected in facing relation to the front panel along the side edge regions thereof. A top gusset connects to the top edge regions of the front and back panels. A handle web is connected to the top edge regions of the front and back panels to provide a carrying loop. The carrying loop is constructed to bridge over the top gusset and between the front and back panels in a configuration arranged to provide for an arm-suspension of the bag with the loop. The carrying loop provides at least two loop faces with each of the loop faces having at least one hand-grip region. The hand-grip region has formed therein a hand-grip opening configured to provide for a hand-suspension of the bag. The carrying loop also has an appointed separation section located between the hand-grip openings. The appointed separation section extends generally aligned with the top edge region of the front panel and is constructed with sufficient tensile load capacity to permit the arm-suspension of the bag while the bag is substantially filled with the articles.

The present invention can advantageously provide a bag package which includes a distinctive arm strap loop. The strap loop can provide for a convenient carrying of the bag while leaving the user's hands substantially free for other tasks. The bag of the invention can also provide a separable strap loop configuration which can operate to provide improved access to the bag contents through the top gusset section of the bag. The supplemental hand-grip openings provided by the present invention allow continued ease of portability even after the bag has been opened and the strap loop has been separated apart. During a subsequent carrying of the bag, the bag contents can remain secure from spilling out. Thus, the present invention can provide a distinctive plastic bag for producing a carton-like package, and can facilitate convenient carrying of the bag while also providing improved accessibility to the bag contents.

BRIEF DESCRIPTION OF THE DRAWINGS

The present invention will be more fully understood and further advantages will become apparent when reference is made to the following detailed description of the invention and the accompanying drawings in which.

DETAILED DESCRIPTION OF THE INVENTION

The present invention provides a distinctive bag for receiving and containing selected articles. The bag is particularly useful for packaging disposable absorbent garments, such as disposable diapers, feminine care products, incontinence garments and the like. It is readily apparent, however, that the bag could be suitable for packaging other articles which can be suitably stacked or otherwise arranged into a carton-like configuration for packaging.

Figure 1:
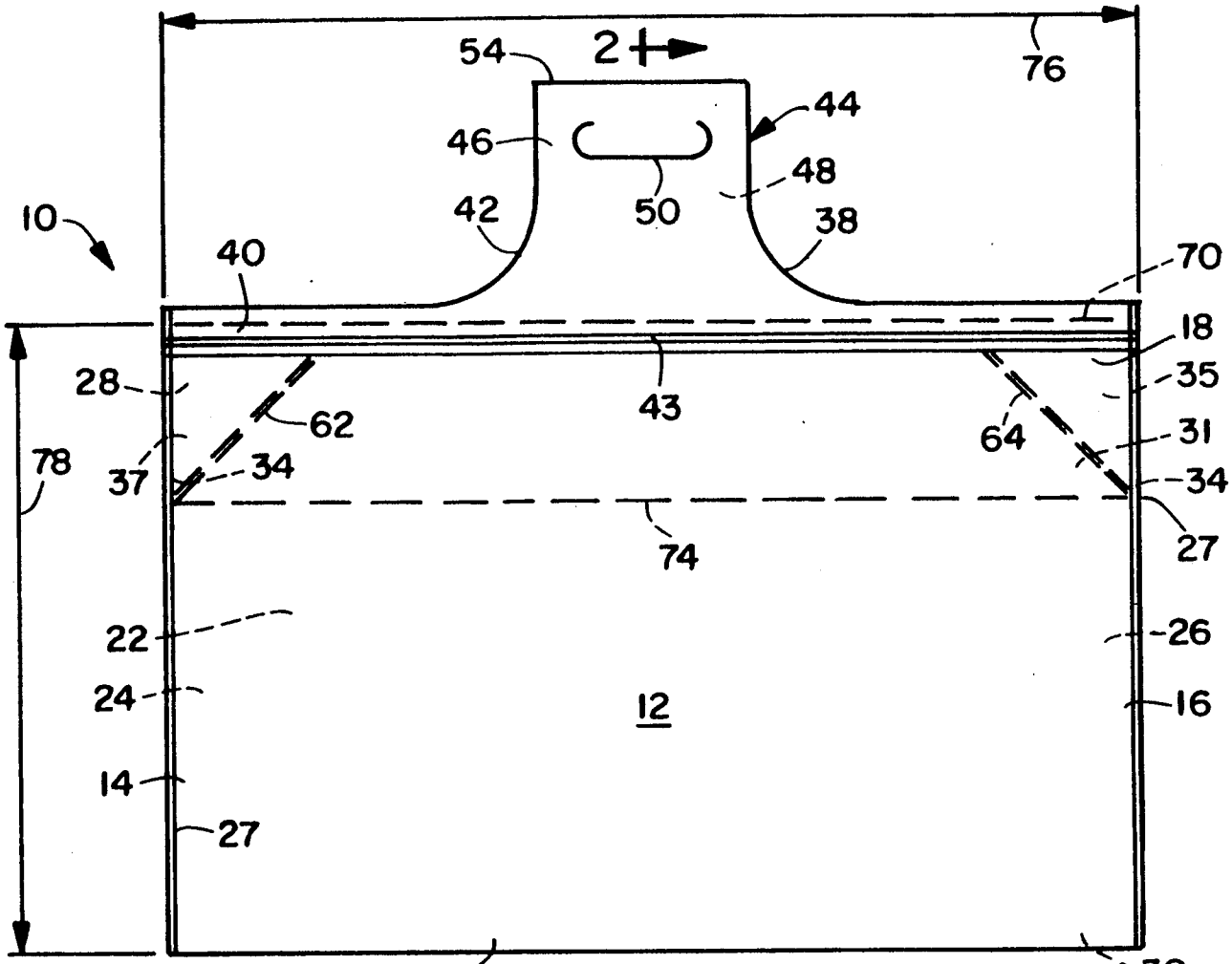
FIG. 1 representatively shows a side view of an unfilled bag.
Figure 3:
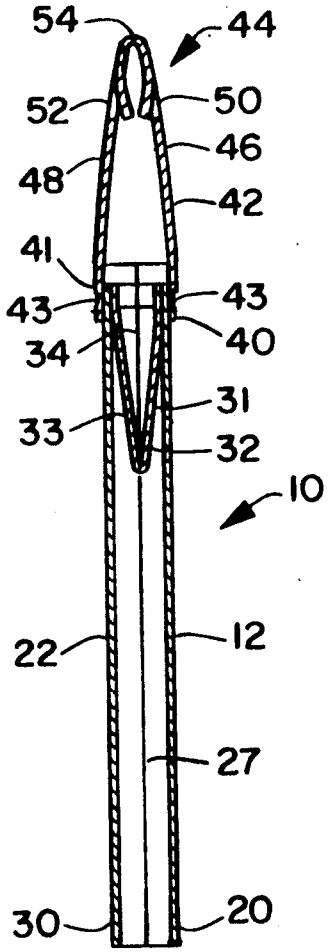
FIG. 3 representatively shows a cross-sectional, end view of another embodiment of the invention.
Figure 2:
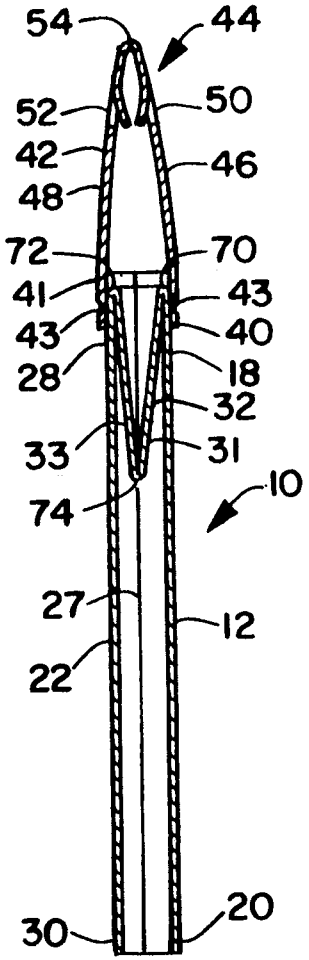
FIG. 2 representatively shows a cross-sectional, end view of the bag taken along line 2—2 of FIG. 1.
Figure 10:
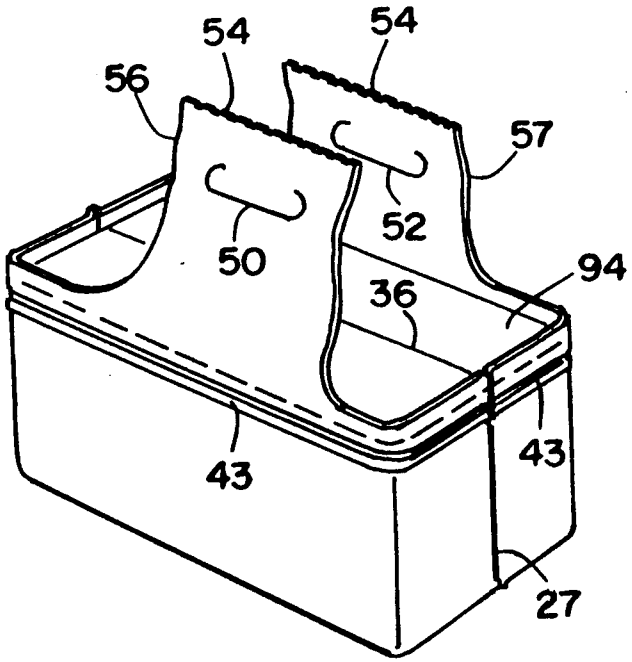
FIG. 10 representatively shows a carrying loop which has been separated into separately moveable strap portions.

With reference to FIGS. 1 and 2, bag 10 includes a front panel 12, which has two opposed side edge regions 14 and 16, a top edge region 18 and a bottom edge region 20. A back panel 22 has two opposed side edge regions 24 and 26, a top edge region 28 and a bottom edge region 30. The back panel is connected in a generally adjacent, facing relation to front panel 12 along the correspondingly adjacent side edge regions thereof. As a result, the two sets of connected side edges (14,24 and 16,26) form a pair of connected end regions. A top gusset member 31 is connected to the top edge regions 18 and 28 of front panel 12 and back panel 22. In addition, a handle web member 38 is connected to the top edge regions 18 and 28 of the front and back panels 12 and 22. Handle web 38 has a mounting portion 40 for connecting to the front and back panels, and a strap portion 42 for providing a carrying loop 44. The carrying loop is constructed to bridge over top gusset 31 and to extend between front panel 12 and back panel 22. The carrying loop is constructed and arranged to provide for an arm-suspension of bag 10 through the use of carrying loop 44. The carrying loop further provides two generally opposed loop faces 46 and 48. Each of the loop faces has at least one hand-grip opening 50 formed therein with the hand-grip openings configured to provide for a hand-suspension of bag 10. Carrying loop 44 has an appointed separation section, such as frangible section 54, located at a selected, intermediate position between handgrip openings 50. The separation section is constructed and arranged to provide for a reconfiguration of the carrying loop into separate, independently movable strap portions 56 and 57 (FIG. 10). In the illustrated embodiment, loop frangible section 54 extends generally aligned with top edge region 18 of front panel 12, and is constructed with sufficient tensile load capacity to permit the arm-suspension of bag 10 while the bag is substantially filled with the selected articles.

Front panel 12 and back panel 22 may be composed of different materials, or may be composed of substantially the same type of material. Typically, the material is a polymer film which is sufficiently flexible to assume a desired, generally hexahedral shape when the bag is substantially filled with articles. In addition, the material should have sufficient strength to hold and contain the articles without breaking and without excessive bulging or stretching of the film material. In the illustrated embodiment, the material may be composed of a polyethylene film or film laminate having a thickness of about 2.5 mils. For example, the material may comprise a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like.

Front panel 12 includes two opposed, generally parallel side edge regions 14 and 16. The front panel further includes a top edge region 18 which generally interconnects and runs substantially perpendicular to the side edge regions. The front panel has a length dimension 76 and a depth dimension 78. It is readily apparent that the panel length and depth dimensions will vary depending upon the desired configuration of the packaged articles.

Back panel 22 includes two opposed, generally parallel side edge regions 24 and 26. The back panel further includes a top edge region 28 which extends substantially perpendicular to side edge regions 24 and 26, and generally interconnects the side edge regions. In the illustrated embodiment back panel 22 is generally coextensive with front panel 12 and is positioned in an adjacent, facing relation with the front panel. Thus, a major face surface of the back panel is located generally parallel and side-by-side to a major face surface of the front panel. The two side edge regions 24 and 26 of back panel 22 are suitably interconnected with the correspondingly adjacent side edge regions 14 and 16 of front panel 12.

The interconnecting assembly of the front and back panels may be accomplished by various techniques well known in the art, such as adhesive bonding, thermal bonding, ultrasonic bonding, welding, and the like. Alternatively, the interconnection may be accomplished with inter-engaging mechanical fastening systems, such as sewing, stapling, riveting, and the like. Similarly, the other component parts of bag 10 described in the present specification can be attached or otherwise connected together employing the above-described assembly techniques. In the illustrated embodiment, back panel 22 and front panel 12 are secured and fused to each other along their respective side edge regions by thermal bonding lines 27.

Top gusset member 31 is operably connected to the top edge regions of 18 and 28 of front panel 12 and back panel 22. Top gusset 31 may be integrally formed with either of front panel 12 or back panel 22, or may be integrally formed with both the front and back panels. Alternatively, top gusset 31 may be a separate web of material which is assembled to top edge region 18 of front panel 12 and top edge region 28 of back panel 22.

The top gusset may be composed of a flexible polymer film material, such as the material employed to construct front panel 12 or back panel 22. In the illustrated embodiment, top gusset 31 is composed of a LDPE film laminate having a thickness of about 2.5 mils.

Figure 6:
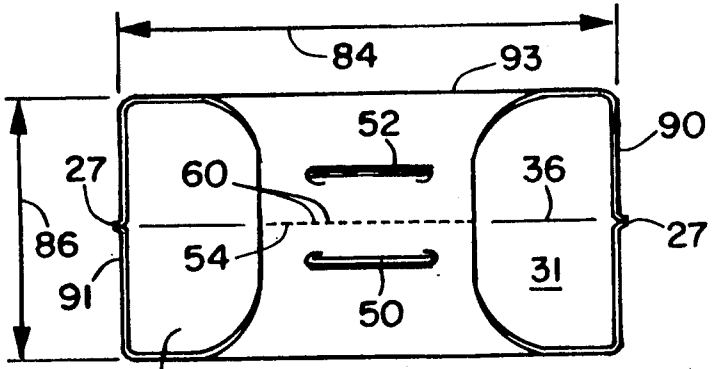
FIG. 6 representatively shows a top view of a filled bag.

With reference to FIG. 2, top gusset 31 is integrally formed with both front panel 12 and back panel 22. Accordingly, a unitary web of material is selectively folded to form the top gusset and the front and back panels. The top gusset extends from fold line 70 to fold line 72 and includes a medial fold line 74. Fold line 70 provides a line of demarcation between front panel 12 and top gusset 31. Similarly, fold line 72 provides a line of demarcation between back panel 22 and the top gusset. Medial fold line 74 effectively divides the top gusset into two gusset panel sections 32 and 33. In the illustrated embodiment, fold line 74 extends substantially down the center of top gusset 31, and generally bisects the top gusset to define gusset panel sections 32 and 33 which are substantially equal in size. The top gusset has a gusset length dimension 76, and has an unfolded, extended width which substantially corresponds to the desired bag width 86 (FIG. 6).

Top gusset member 31 in its folded condition, operably delimits two panel sections 32 and 33, with each panel section including its respective portions of gusset end regions 35 and 37. In the construction of the illustrated embodiment, top gusset 31 is positioned in its folded condition and the gusset end portions of gusset panel section 32 are suitably attached by bonding lines 34 or otherwise connected to the correspondingly adjacent gusset end portions of gusset panel section 33. Additionally, the gusset end portions of gusset panel section 32 are connected to side edge regions 14 and 16 of front panel 12, and the gusset end portions of gusset panel section 33 are suitably connected to side edge regions 24 and 26 of back panel 22.

In an alternative embodiment of the invention where top gusset 31 is a separate member assembled to front panel 12 and back panel 22, the top gusset member may be composed of a material which is different than the material comprising the front and back panels. Upon assembly, the longitudinal, lengthwise edge regions of the top gusset member will be connected by suitable fastening mechanisms to the front and back panels along the regions thereof which generally correspond to fold lines 70 and 72.

Figure 9:
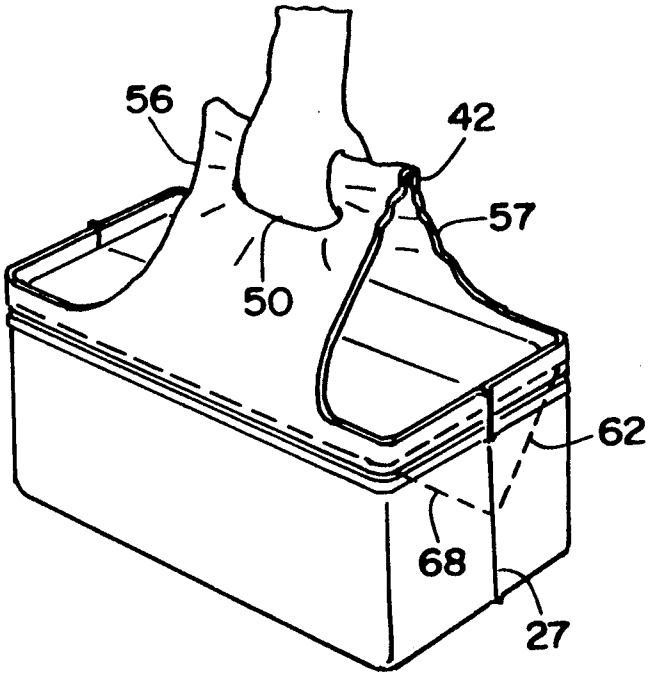
FIG. 9 representatively shows a hand-suspension of a filled bag.
Figure 11:
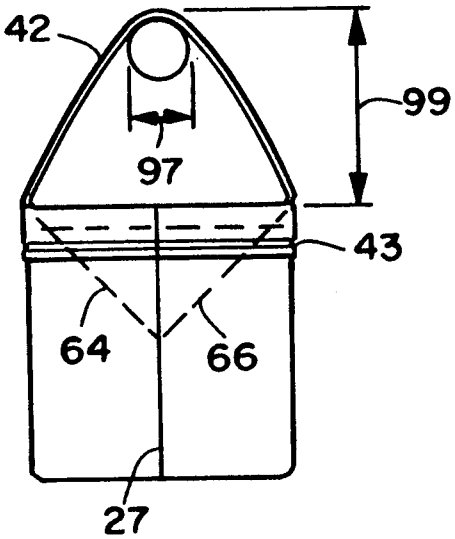
FIG. 11 representatively shows a carrying loop which has been extended to measure its height extent.

In a particular embodiment of the invention, the panel sections of top gusset 31 may be joined to front panel 12 and back panel 22 with selected groups of diagonally extending lines of attachment. With reference to FIGS. 9 and 11, gusset panel section 32 can be attached to front panel 12 with diagonally extending lines of attachment, such as gusset thermal bonds 62 and 64. Similarly, gusset panel section 33 can be attached to back panel 22 with diagonal thermal bonds 66 and 68. The angle and placement of the diagonal bonds are selected and arranged such that the filled package assumes and reliably maintains the desired carton-like appearance. In the representatively shown embodiment, the diagonal bonds have a width of about 0.125 in, and have a length which is generally aligned at an angle of about 45° downwardly from bond line 43. The downward end of the diagonal bond intersects its respective side panel bond 27 at a point located approximately 0.75 in above gusset fold line 74. The side panel bond is about 0.375 inch wide.

Top gusset 31 may optionally include a frangible section 36 (FIG. 6) for facilitating access to the bag contents. The frangibility of top gusset 31 may, for example, be provided by a partial cutting through the thickness of the top gusset material in a predetermined pattern, providing a selected pattern of perforations along the top gusset, providing desired pattern of stress-fatigue weakening along a section of the top gusset material, or the like. In the illustrated embodiment, gusset frangible section 36 is provided by a line of perforations which extends generally along gusset fold line 74. Alternatively, gusset frangible section 36 may be provided by a curvilinear or patterned arrangement of perforations distributed along a selected section of the top gusset. In the illustrated embodiment, there are approximately 3–4 perforations per lineal inch of fold line 74.

Handle web 38 is suitably connected to front panel 12 and back panel 22 to provide a bag carrying system. The handle web is composed of a flexible web material, such as a polymer material composed of a MDPE/LDPE film laminate or a HDPE film, which has sufficient tensile strength and sufficient load capacity to support the weight of a filled bag while the bag is suspended by the handle web. In the illustrated embodiment, handle web 38 is composed of a MDPE/LDPE film material having a web thickness of about 4 mils.

The handle web has a mounting portion, such as mounting sections 40 and 41, for connecting the handle web to the front and back panels, respectively. In the illustrated embodiment, the mounting sections 40 and 41 of handle web 38 are constructed to extend substantially along the entire length of the top edge regions 18 of front panel 12 and back panel 22. As a result, the mounting sections can be attached, for example with bonds 43, along substantially the entire top edge periphery of the filled package. Such a configuration can more widely spread and distribute the carrying stresses induced by using the handle web to transport a filled bag. Optionally, the mounting sections of handle web may be bonded along an extent which is less than the entire length of the top edge regions of the front and back panels. Preferably, mounting sections 40 and 41 extend the entire length of top edge regions 18.

Figure 8:
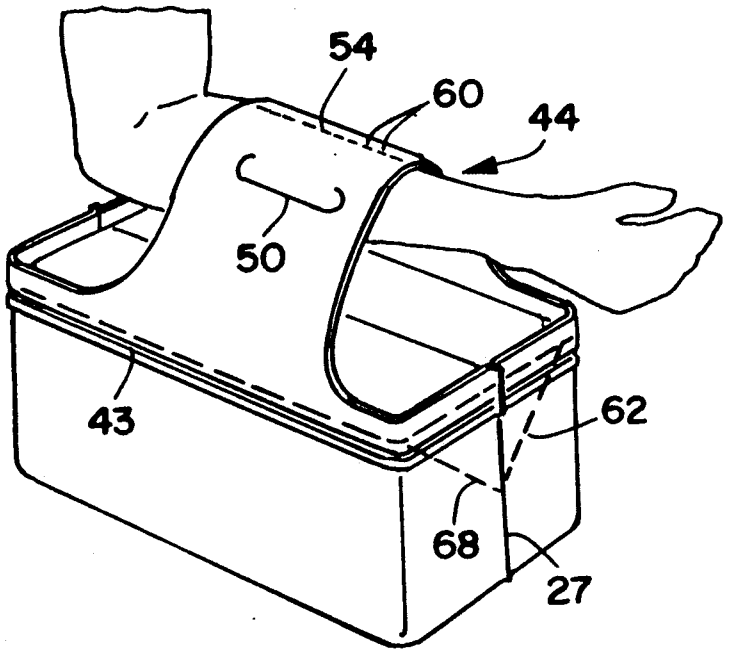
FIG. 8 representatively shows an arm-suspension of a filled bag.

Handle web 38 further includes a strap portion 42 for providing a carrying loop 44. The carrying loop is constructed to continuously bridge over top gusset 31 and to extend between front panel 12 and back panel 22 in a generally arched configuration. As a result, carrying loop 44 can be arranged to provide for an arm-suspension of bag 10 through the operation of loop 44, as illustrated in FIG. 8.

In its arched configuration, carrying loop 44 provides two generally opposed loop faces 46 and 48. Each of the loop faces has at least one hand-grip opening 50 and 52 formed therein by a suitable technique, such as die-cutting. The hand-grip openings are configured for a hand-suspension of bag 10, as illustrated in FIG. 9, and the openings identify the hand-grip region of the carrying loop.

Figure 7:
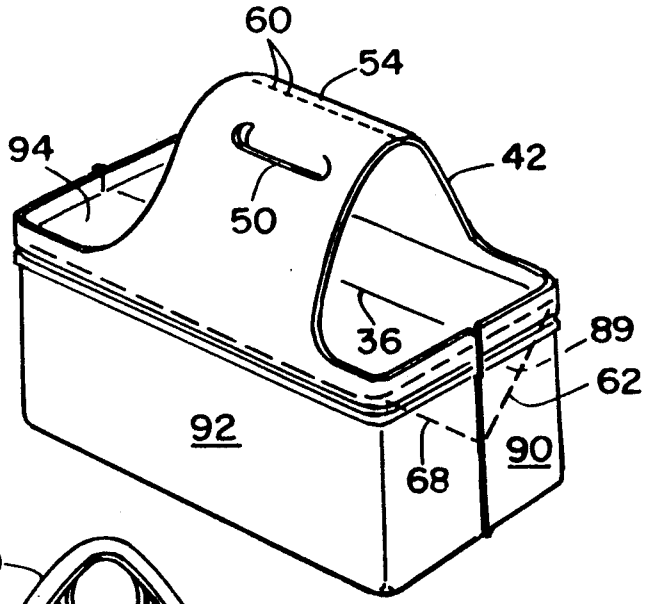
FIG. 7 representatively shows a perspective view of a filled bag.
Figure 5:
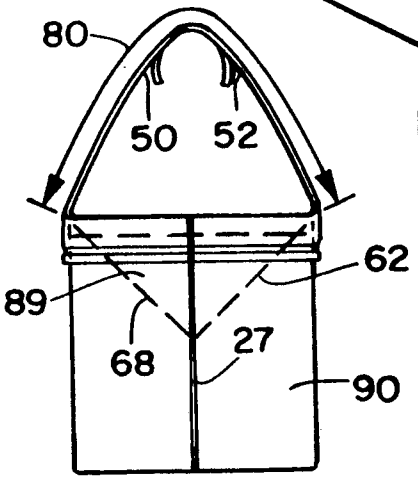
FIG. 5 representatively shows an end view of a filled bag.

As representatively shown in FIGS. 6 and 7, carrying loop 44 includes an appointed separation region, such as frangible section 54, which is distinctively located and arranged at an intermediate position between hand-grip openings 50 and 52. The loop frangible section is constructed to provide for a separation and reconfiguration of the carrying loop into generally independently movable strap portions 56 and 57, as illustrated in FIG. 10. The resultant strap portions are then capable of being individually repositioned to completely disconnect the original bridging between the front and back panels produced by carrying loop 44. The shown configuration of the carrying loop is devoid of any seams or bonding lines which might interfere with the desired operation of the appointed separation region.

In the illustrated embodiment, loop frangible section 54 defines a direction of separability (e.g. frangibility) which extends generally parallel with top edge region 18 of front panel 12. The separability or frangibility of section 54 may be provided by any suitable treatment which reduces the strength of section 54 relative to the remainder of carrying loop 44. For example, the frangibility of section 54 may be provided by selectively reducing the web thickness along section 54, by providing a line of perforations 60 along the frangible section, by inducing a pattern of stress fatigue weakness along frangible section 54, or by a like arrangement.

While loop frangible section 54 may be relatively weaker than the remainder of carrying loop 44, the frangible section is constructed with sufficient tensile load capacity to permit the arm-suspension of bag 10 while the bag is substantially filled with contained articles. More particularly, loop frangible section 54 has a tensile load capacity of at least about 6.15 kg preferably has a tensile load capacity of at least about 14.4 kg and more preferably has a tensile load capacity of at least about 18.7 kg. In the illustrated embodiment, the loop frangible section has a tensile load capacity within the range of about 12.5–22 kg.

A suitable procedure for determining the tensile load capacity of frangible section 54 or other portion of handle web 38 involves the use of procedure ASTM D882-83, "Standard Test Methods for Tensile Properties of Thin Plastic Sheeting" to ascertain the tensile-strength-at-break of the web material. This tensile strength property is determined along the direction of the web material in which the major supporting force would be applied when carrying a filled bag. The tensile load capacity of a complete, full-width web section, such as the full-width web section incorporating frangible section 54, can then be calculated after determining the effective cross-sectional area across the complete width of the web section under evaluation. The determination of such cross-sectional area would take into account any localized reduction of the cross-sectional area through the web material at the particular section being examined. For example, it is readily apparent that the presence of perforations or hand-grip openings would reduce the cross-sectional area of web material actually available to support any applied carrying forces. Thus, when determining the tensile load capacity of frangible section 54, the direction of the applied tensile force is considered to be oriented substantially perpendicular to the direction of separability (e.g. line of perforations) of the frangible section, and the presence of perforations would reduce the effective cross-sectional area of this web section.

Strap portion 42 has a strap length 80 and a strap width 82, and loop frangible section 54 extends generally along strap width 82. Strap length 80 is selected to provide a loop size which is convenient for carrying while the bag is suspended from a user's arm through use of carrying loop 44. It will be readily apparent that the specific strap length will depend upon the final width dimension of a filled bag.

In a particular embodiment of the invention, strap 42 provides a loop height 99 of at least about 8.9 cm when carrying loop 44 is fully extended above top gusset 31 around an arm member having a circular diameter 97 of 5.5 cm (FIG. 11). Preferably, the loop height is at least about 15 cm, and more preferably, the loop height is at least about 20 cm.

In a particular aspect of the invention, loop frangible section 54 is constructed and arranged to provide a substantially "clean" tear along the directional line of separability while also providing the desired tensile load capacity. In the illustrated embodiment, the frangible section comprises a line of perforations with each perforation having a generally ">"-shaped, arrowhead configuration. The arrowhead perforation is defined by two linear fracture voids, which intersect at the "head" ends thereof and are separated apart at their oppositely located "tail" ends. The separation between the tail ends of the fracture lines is about 1 mm, and the head to tail length of each arrowhead perforation is about 1/16 in. The tail to head spacing between successive perforations is about ¼ in.

Bag 10 is typically filled through the bottom of the bag. When substantially filled with articles, the resultant package has a generally hexahedron shape, as representatively shown in FIG. 7.

Figure 4:
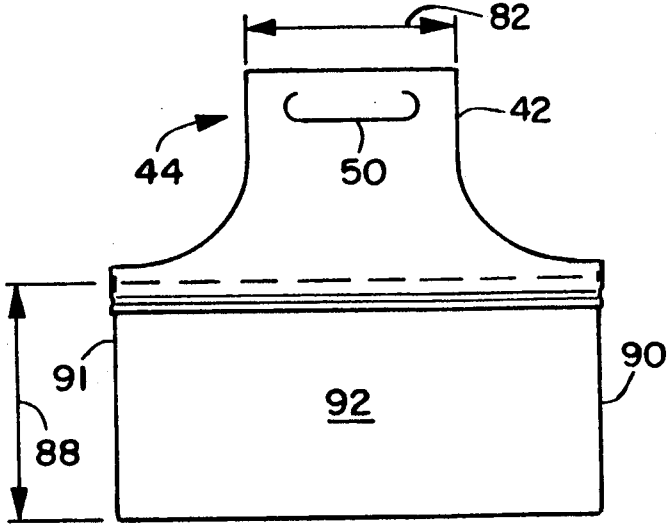
FIG. 4 representatively shows a side view of a filled bag.

With reference to FIGS. 4 and 6, bag 10 in its filled-package form has a package length 84, a package width 86 and a package depth 88. Medial portions of front panel 12 and back panel 22 form package side walls 92 and 93. Longitudinal end regions of front panel 12 and back panel 22 form package end walls 90 and 91 with the bonding line of attachment 27 running along the end walls in the depth dimension of the package.

Top gusset member 31 becomes extended with the medial portion of the top gusset forming package top wall 94. As bag 10 is filled with articles, longitudinal end regions of top gusset 31 become folded and tucked into the interior of the package to form generally triangular-shaped tucks 89. Where diagonal bonds 62, 64, 66 and 68 are employed to secure selected portions of top gusset 31 to front panel 12 and back panel 22, tucks 89 are securely held against package end walls 90 and 91. As a result, the contained articles are substantially prevented from migrating into the space between tuck 89 and package end walls 90 and 91. Such migration could undesirably distort the package shape, inhibit efficient stacking of the filled packages and degrade the aesthetic appearance of the packages when displayed on retail shelves.

To open the package to gain access to the product articles, loop frangible section 54 can be cut, broken or otherwise separated into movable strap portions 56 and 57 (FIG. 10). The movable strap portions may be conveniently draped to the sides of the bag to provide a convenient, substantially unimpeded access to package top wall 94. Gusset frangible section 36 can then be cut, broken, or otherwise separated to provide open access to the articles through the top of the bag.

After the package has been opened, the separated strap portions can still be used to carry the package. In particular, movable strap portions 56 and 57 can be redrawn together in an adjacent facing relation so that a person's hand can be simultaneously inserted through both grip openings 50 and 52. To facilitate this handgrip carrying mode, the hand-grip regions of the movable straps (wherein the hand-grip openings are positioned) are constructed to provide a total tensile load capacity of at least about 22 kg, and preferably, are constructed to provide a tensile load capacity within the range of about 25–50 kg.

The use of the two grip openings and the two strap portions 56 and 57 can advantageously distribute the carrying load to both side walls 92 and 93 of the package. As a result, the carried package can be balanced in the person's hand and is less likely to tip to either side. In addition, the distribution of the carrying load to both of the package side walls 92 and 93, can help to hold closed the opening through top gusset 31, and allows transport of the package with a reduced risk of spilling the contained articles. Once the carrying operation is complete, strap portions 56 can again be repositioned and draped away from top gusset 31 to facilitate access to the articles through the open top gusset.

Figure 12:
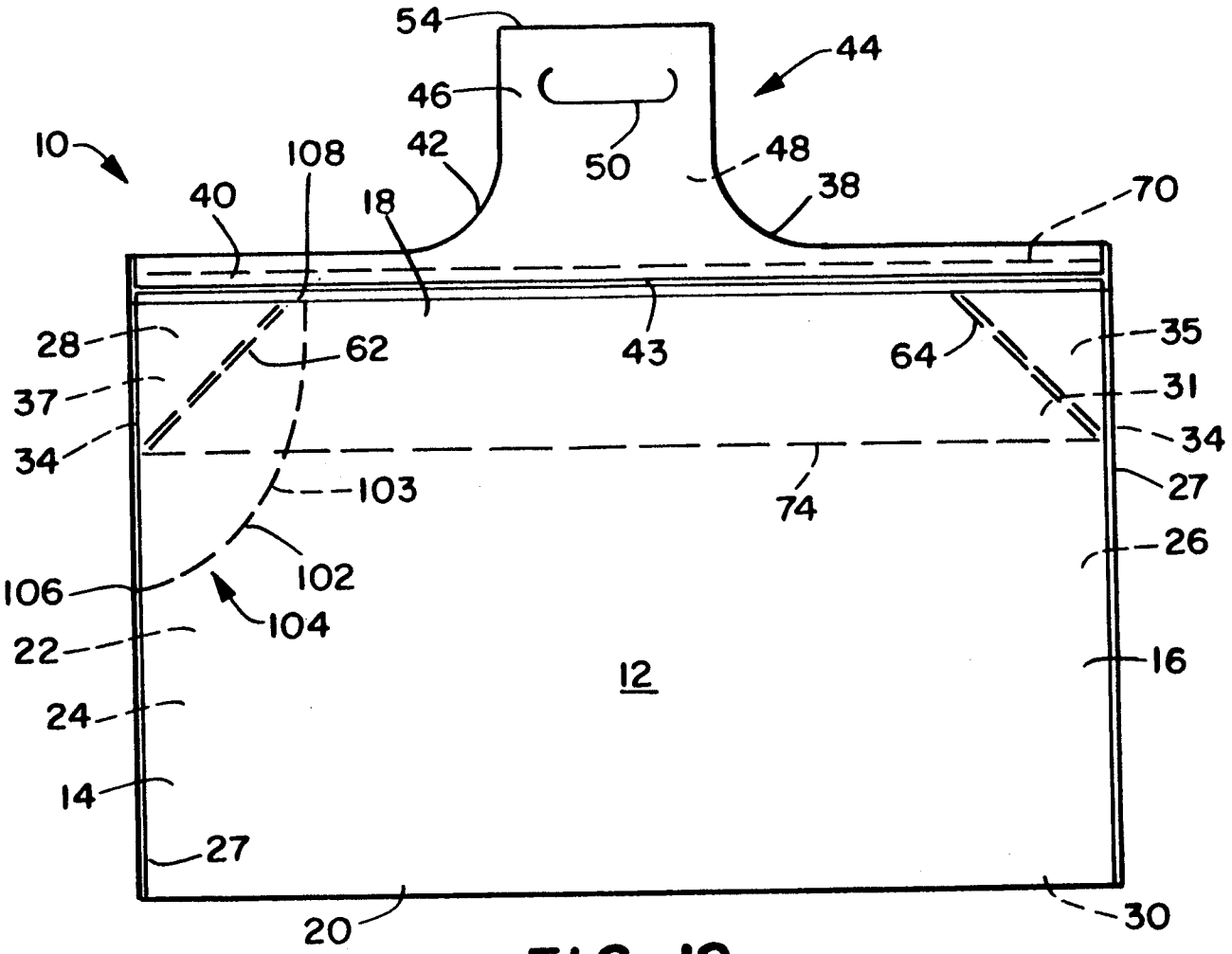
FIG. 12 representatively shows a side view of a bag having a side-opening mechanism.

Referring now to FIG. 12, bag 10 can also be configured with a distinctive side-opening mechanism generally shown at 104. In the illustrated embodiment, the side-opening mechanism comprises an end region of separability, such as frangible lines of perforations 102 and 103 which are formed into front panel 12 and back panel 22, respectively, and positioned generally at side edge regions 14 and 24 to define flap section 110. Alternatively, the perforations may be located at side edge region 16 and 26 or at both of the pairs of side edge regions 14,24 and 16,26. The representatively shown perforation 102 is arranged along a line which intersects side panel bond 27 and extends along front panel 12 to intersect top edge region 18 of the front panel.

Figure 14A:
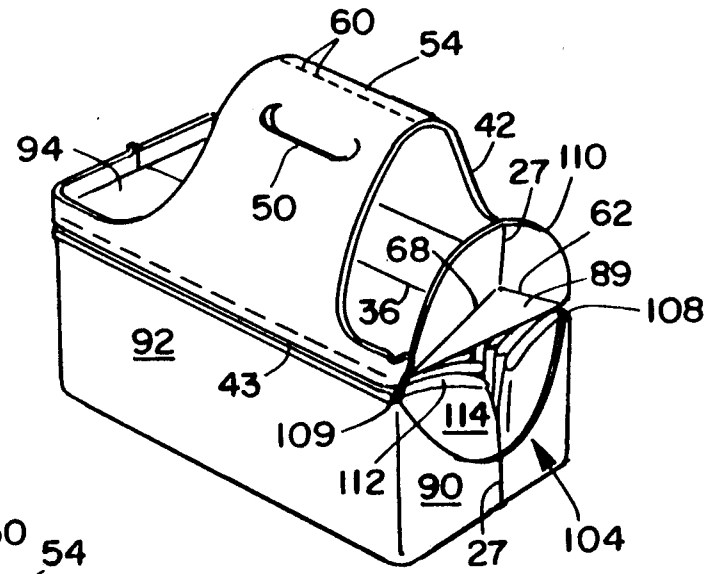
FIGS. 14A and 14B representatively show perspective views of a filled bag having the side-opening mechanism opened to different positions.
Figure 13:
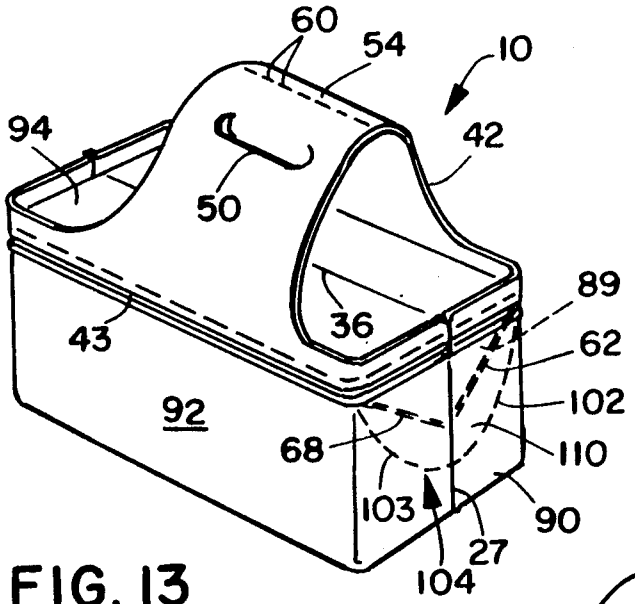
FIG. 13 representatively shows a perspective view of a filled bag having a side-opening mechanism.

Similarly, the representatively shown perforation 103 is arranged along a line which intersects side panel bond 27 and extends along front panel 22 to intersect top edge region 18 of the back panel. Perforation lines 102 and 103 intersect side panel bond 27 at a substantially common point 106. The common point is positioned about 28–71% of panel depth 78 from the top edge of front panel 12. In preferred arrangements, the common point is positioned about 56% or about 67% of panel depth 78 from the top edge of front panel 12. In the shown embodiment the perforation lines are curvilinear, but may optionally be linear or any other operable configuration.

Where panels 12 and 22 include gusset diagonal bonds, such as bonds 62 and 68 (FIG. 13), it is preferred that perforation lines 102 and 103 substantially avoid crossing over the diagonal bonds. The absence of such cross-over can enhance the operability of the side-opening mechanism and help create a side-opening having a neater appearance. In a particular aspect of the invention, perforation line 102 and diagonal bond 62 have a substantially common point of intersection 108 with the top edge of front panel 12; similarly, perforation line 103 and diagonal bond 68 have a substantially common point of intersection 109 (FIG. 14A) with the top edge of back panel 22.

Referring now to FIG. 13, which again illustrates a representative bag in its filled package configuration, side-opening mechanism 104 is restricted to end wall 90 of the package and comprises a region of relative weakness, such as frangible perforation lines 102 and 103. In the shown embodiment, the lines of frangibility substantially avoid extending or crossing into the area covered by package top wall 94 (gusset 31), and are at only one end of the package. The perforation lines cooperate to form an arcuate line of perforations which is upwardly concave and delimits an end flap section 110. For example, the perforation lines may define a generally parabolic or "U" shape. The lower apex region of the flap is the general region around point 106, and at the opposite, open region of the curve shape where flap 110 intersects the top edge of the package, the width of flap 110 is substantially equal to package width 86 (FIG. 6). As a result, area of flap 110 overlies substantially the total area of tuck 89, and the area covered by tuck 89 is positioned within the area covered by flap 110.

Figure 14B:
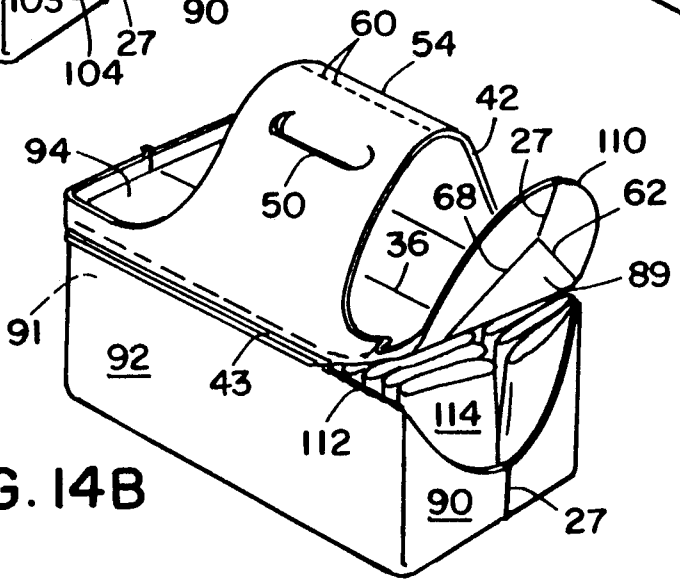

To operate side-opening mechanism 104, the apex of flap 110 is separated from package end wall 90, such as by pressing inwardly to initially fracture the bag material along the local perforations and then grasping the separated section of the flap to pull it outwardly and upwardly (FIG. 14) until the separation reaches points 108 and 109.

In the illustrated embodiment, the contained articles 112 are positioned with the edges of the articles adjacent the package side walls 92 and 93, and with the faces of the articles aligned generally parallel with the package end walls 90 and 91. The shown articles are generally rectangular in shape, and typically, are slightly compressed when they are inserted into the package. Examples of such articles include folded disposable diapers or disposable incontinence garments. With the compressed articles, the opening of flap 110 relieves the restraining force of the package on the exposed, endmost article 114. The expansive forces exerted by the other articles compressed within the package then urges and bends the exposed portion of article 114 out of the package, and presents the article for easy grasping by the user.

In a particular aspect of the invention, the front and back panels comprising bag 10 are configures with an extended region of relative weakness which is aligned along the package length 84 (FIG. 6) and is located substantially adjacent the top edge of the package. The extended region of weakness is arranged to intersect perforation lines 102 and 103 at or near the top edges of front panel 12 and back panel 22, respectively. Such region of weakness may, for example, be provided by aligning the "grain" of the material comprising front panel 12 and back panel 22 along package length 84. As another example, such region of weakness may be provided by configuring the package with a construction which induces a stress concentration along bonds 43 when a continued pulling force is applied to the flap after the separation between flap 110 and the package end wall has reached points 108 and 109. The continued pulling force can then separate all or part of top wall 94 (gusset 31) away from the package to expose to the user the top edges of a larger quantity of contained articles, as representatively shown in FIG. 14B. As a result, the user can advantageously have improved and easier access to the packaged articles.

Having thus described the invention in rather full detail, it will be readily apparent that various changes and modifications may be made without modifications are contemplated as being within the scope of the invention, as defined by the subjoined claims.

We claim:

1. A bag for receiving and containing selected articles, comprising:

a front panel having two opposed side edge regions and a top edge region;

a back panel having two opposed side edge regions and a top edge region, said back panel connected in facing relation to said front panel along the side edge regions thereof;

a top gusset which is connected to the top edge regions of said front panel and back panel, and has a first gusset panel section attached to a side region of said front panel along a first diagonal line of attachment and a second diagonal line of attachment; and a handle web connected to substantially the entire length of said top edge regions of said front and back panels;

said front and back panels having formed therein a side-opening mechanism which has an end opening flap defined by an end region of separability formed into said side edge regions of said front and back panels, said end region of separability extending along said front and back panels from side edges of said front and back panels to top edge regions thereof and arranged to substantially avoid crossing over said diagonal lines of attachment of said top gusset, and said end opening flap overlying substantially the total area of a tuck formed by a region of said top gusset which becomes folded into an interior of said bag when the bag is filled;

said handle web having a mounting portion for connecting to said front and back panels and a strap portion for providing a carrying loop;

said carrying loop constructed to bridge over said top gusset and between said front and back panels, and arranged to provide for an arm-suspension of said bag with said loop;

said carrying loop providing two generally opposed loop faces with each of said loop faces having at least one hand-grip region, said region having formed therein a hand-grip opening configured for a hand-suspension of said bag;

said carrying loop having an appointed frangible section located between said hand-grip openings to provide for a reconfiguration of said carrying loop into separately movable strap portions;

said frangible section extending generally parallel with said top edge region of said front panel and constructed with sufficient tensile load capacity to permit the arm-suspension of said bag while the bag is substantially filled with said articles.

2. A bag as recited in claim 1, wherein said top gusset includes a frangible gusset section which provides for a top opening of said bag to gain access to said articles.

3. A bag as recited in claim 1, wherein said top gusset has a medial fold line along a length dimension thereof to define said first and second gusset panels.

4. A bag as recited in claim 1, wherein said mounting portion of said handle web extends along substantially the total length of said top edge regions of said front and back panels.

5. A bag as recited in claim 1, wherein said strap portion of said handle web is constructed to provide a carrying loop which extends at least about 8.9 cm above said top gusset when said bag is substantially filled with said articles.

6. A bag as recited in claim 1, wherein said frangible portion of said carrying loop has a tensile load capacity of at least about 6.15 kg.

7. A bag as recited in claim 1, wherein said frangible portion of said carrying loop has a tensile load capacity of at least about 14.5 kg.

8. A bag as recited in claim 1, wherein said frangible portion of said carrying loop has a tensile load capacity of at least about 18.7 kg.

9. A bag as recited in claim 1, wherein said frangible portion of said carrying loop has a tensile load capacity within the range of about 12.5–22 kg.

10. A bag as recited in claim 9, wherein said hand-grip region of said carrying loop has a tensile load capacity of at least about 22 kg.

11. A bag as recited in claim 9, wherein said hand-grip region of said carrying loop has a tensile load capacity within the range of about 25–50 kg.

12. A bag as recited in claim 1, wherein said end region of separability comprises frangible lines of perforations.

13. A bag as recited in claim 1, wherein said end region of separability further comprises an extended region of relative weakness which is aligned along a length of said bag and extends substantially adjacent said top edges of said front and back panels.

14. A bag as recited in claim 1, wherein said end region of separability and said first diagonal line of attachment have a substantially common point of intersection with the top edge region of said front panel, and said end region of separability and said second diagonal line of attachment have a substantially common point of intersection with the top edge region of said back panel.

15. A bag as recited in claim 1, wherein said end region of separability substantially avoids extending into a package top wall which is provided by said bag in its filled form.

16. A bag for receiving and containing selected articles, comprising:

a front panel having two opposed side edge regions and a top edge region;

a back panel having two opposed side edge regions and a top edge region, said back panel connected in facing relation to said front panel along the side edge regions thereof;

a top gusset connected to the top edge regions of said front panel and back panel, said top gusset having a first gusset section attached to a side region of said front panel along a first diagonal line of attachment and a second gusset section attached to a side region of said back panel along a second diagonal line of attachment; and a handle web connected to substantially the entire length of said top edge regions of said front and back panels, said handle web having a mounting portion for connecting to said front and back panels and a strap portion;

wherein said front and back panels have formed therein a side-opening mechanism which includes an end opening flap defined by an end region of separability formed into side edge regions of said front and back panels, said end region of separability extends along said front and back panels from side edges of said front and back panels to the top edge regions thereof, said end region of separability is arranged to substantially avoid crossing over said diagonal lines of gusset attachment, said end region of separability and said first diagonal line of attachment have a substantially common point of intersection with the top edge region of said front panel, and wherein said end region of separability and said second diagonal line of attachment have a substantially common point of intersection with the top edge region of said back panel.

17. A bag as recited in claim 16, wherein said end region of separability comprises frangible lines of perforations.

18. A bag as recited in claim 16, wherein said end region of separability further comprises an extended region of relative weakness which is aligned along a length of said bag and located substantially adjacent said top edge regions of said front and back panels.

19. A bag as recited in claim 16, wherein a region said top gusset is constructed to become folded into an interior of said bag to form a tuck having a tuck area when the bag is filled, and wherein said end flap overlies substantially the total tuck area.

20. A bag as recited in claim 16, wherein said end region of separability substantially avoids extending into a package top wall provided by said bag in its filled form.

21. A bag for receiving and containing selected articles, comprising:

a front panel having two opposed side edge regions and a top edge region;

a back panel having two opposed side edge regions and a top edge region, said back panel connected tin facing relation to said front panel along the side edge regions thereof to form connected end regions;

a top gusset connected to the top edge regions of said front panel and back panel, said top gusset having a first gusset section attached to side regions of said front panel along first diagonal lines of attachment and a second gusset section attached to side regions of said back panel along second diagonal lines of attachment, and a region of said top gusset being constructed to become folded into an interior of said bag to form a tuck having a tuck area when the bag is filled;

a handle web connected to substantially the entire length of said top edge regions of said front and back panels to provide a carrying loop; and separation means located only in one of said connected end regions to provide for an opening in said end region to permit an easy access and removal of said selected articles, said separation means comprising a line of separability which extends along said front and back panels from side edges of said front and back panels to top edge regions thereof while substantially avoiding crossing over said diagonal lines of attachment of said top gusset, and said line of separability defining an end opening flap which overlies substantially the total tuck area of said top gusset.

22. A bag as recited in claim 21, wherein said end region opening is located in an upper 67% of said end region.

23. A bag as recited in claim 22, wherein said separation means comprises a generally parabolic line of perforations.

24. A bag as recited in claim 22, wherein said separation means comprises a generally U-shape line of perforations.

25. A bag as recited in claim 21, wherein said end region of separability and said first diagonal line of attachment have a substantially common point of intersection with the top edge region of said front panel, and said end region of separability and said second diagonal line of attachment have a substantially common point of intersection with the top edge region of said back panel.

26. A bag as recited in claim 25, wherein said end region of separability further comprises an extended region of relative weakness which is aligned along a length of said bag and located substantially adjacent said top edges of said front and back panels.

27. A bag as recited in claim 21, wherein said end region of separability substantially avoids extending into a package top wall provided by said bag in its filled form.

28. A bag for receiving and containing selected articles, comprising:

a front panel having two opposed side edge regions and a top edge region, said back panel connected in facing relation to said front panel along the side edge regions thereof;

a top gusset connected to the top edge regions of said front panel and back panel, said top gusset having a first gusset section attached to a side region of said front panel along a first diagonal line of attachment and a second gusset section attached to a side region of said back panel along a second diagonal line of attachment; and a handle web connected to substantially the entire length of said top edge regions of said front and back panels to provide a carrying loop, said carrying loop constructed to bridge over said top gusset and between said front and back panels with an extension of at least about 8.9 cm above said top gusset when said bag is substantially filled to provide for an arm-suspension of said bag through said loop, said carrying loop providing at least tow loop faces with each of said loop faces having at least one hand-grip region, said hand-grip region having formed therein a hand-grip opening configured to provide for a hand-suspension of said bag, said carrying loop having an appointed separation section located between said hand-grip openings, said appointed separation section extending generally aligned with said top edge region of said front panel and constructed with a tensile load capacity of at least about 6.15 kg to permit said arm-suspension of said bag while the bag is substantially filled with said articles;

wherein said front and back panels have formed therein a side-opening means which includes an end opening flap defined by an end region of separability, said end region of separability extends along said front and back panels from side edges of said front and back panels to top edge regions thereof while substantially avoiding crossing over said diagonal lines of attachment of said top gusset, and wherein said end region of separability substantially avoids extending into a package top wall which is provided by said bag in its filled form.

29. A bag as recited in claim 28, wherein an end region of said top gusset is constructed to become folded into said bag against an end wall of said bag when filled to thereby form an interior tuck having a tuck area, and wherein said end opening flap is constructed to very substantially a total area of said tuck.

30. A bag as recited in claim 29, wherein said end region of separability further comprises an extended region of relative weakness which is aligned along a length of said bag and extends substantially adjacent said top edges of said front and back panels.

31. A bag as recited in claim 28, wherein said end region of separability and said first diagonal line of attachment have a substantially common point of intersection with the top edge region of said front panel, and said end region of separability and said second diagonal line of attachment have a substantially common point of intersection with the top edge region of said back panel.

* * * * *

UNITED STATES PATENT AND TRADEMARK OFFICE

CERTIFICATE OF CORRECTION

PATENT NO. : 5,121,995

DATED : June 16, 1992

INVENTOR(S) : William R. Newman et al.

It is certified that error appears in the above-identified patent and that said Letters Patent is hereby corrected as shown below:

IN THE ABSTRACT

Line 5, delete "tip" and substitute therefor -- top --.

Column 2, line 3, delete "Sendewal" and substitute therefor -- Sengewald --.

Signed and Sealed this

Seventh Day of December, 1993

*Attest:*

*Attesting Officer*

Bruce Lehman

BRUCE LEHMAN

*Commissioner of Patents and Trademarks*